US010126001B2

(12) United States Patent
Gambardella et al.

(10) Patent No.: US 10,126,001 B2
(45) Date of Patent: Nov. 13, 2018

(54) METHOD FOR MANUFACTURING A HOUSEHOLD COOKING APPLIANCE, AND CORRESPONDING HOUSEHOLD COOKING APPLIANCE

(71) Applicant: WHIRLPOOL EMEA S.P.A., Pero (MI) (IT)

(72) Inventors: Fabio Gambardella, Cantanzaro Lido (IT); Matteo Scoponi, Civitanova Marche (IT)

(73) Assignee: Whirlpool EMEA S.p.A., Pero (MI) (IT)

( * ) Notice: Subject to any disclaimer, the term of this patent is extended or adjusted under 35 U.S.C. 154(b) by 199 days.

(21) Appl. No.: 15/102,022

(22) PCT Filed: Dec. 1, 2014

(86) PCT No.: PCT/IB2014/066472
§ 371 (c)(1),
(2) Date: Jun. 6, 2016

(87) PCT Pub. No.: WO2015/087195
PCT Pub. Date: Jun. 18, 2015

(65) Prior Publication Data

US 2016/0305670 A1 Oct. 20, 2016

(30) Foreign Application Priority Data

Dec. 10, 2013 (IT) ..... TO2013A1008

(51) Int. Cl.
*A21B 1/00* (2006.01)
*F24C 15/32* (2006.01)
*F24C 15/20* (2006.01)

(52) U.S. Cl.
CPC ..... *F24C 15/325* (2013.01); *F24C 15/2007* (2013.01); *F24C 15/322* (2013.01)

(58) Field of Classification Search
CPC ... F24C 15/325; F24C 15/322; F24C 15/2007
See application file for complete search history.

(56) References Cited

U.S. PATENT DOCUMENTS 4,753,018 A 6/1988 Golichowski

FOREIGN PATENT DOCUMENTS

EP 2636955 9/2013

*Primary Examiner* — Shawntina Fuqua
(74) *Attorney, Agent, or Firm* — Price Heneveld LLP

(57) ABSTRACT

A method for manufacturing a household cooking appliance, in particular an oven, having a muffle defining a cooking chamber, includes the steps of:

a) providing the muffle;
b) providing a channel for conveying air;
c) associating to a rear wall of the muffle a first fan for ventilation of the cooking chamber;
d) associating to the channel a second fan for forcing air into the channel;
e) associating the channel to an upper wall of the muffle.

Step b) includes shearing from a semi-finished product of a metal component of the channel a corresponding portion, so as to define an opening for installation of the second fan.

Step c) includes using the portion sheared from the semi-finished product of the metal component of the channel as a bracket for fixing the first fan to the rear wall of the muffle.

10 Claims, 5 Drawing Sheets

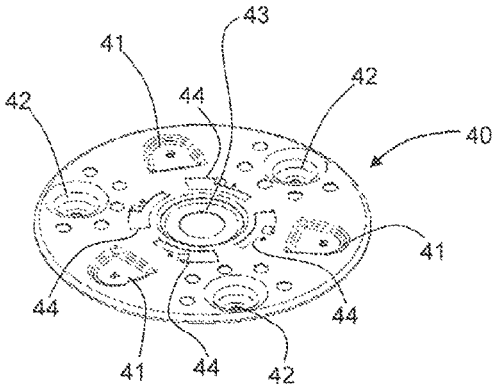
Fig. 9
Fig. 10
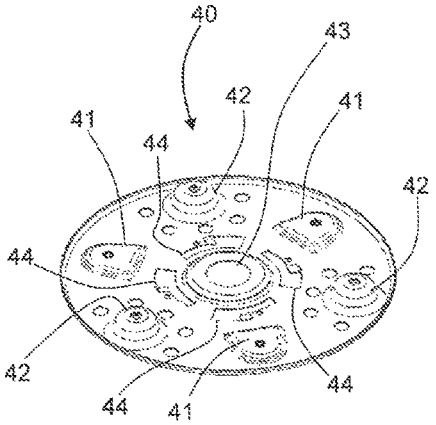
Fig. 11
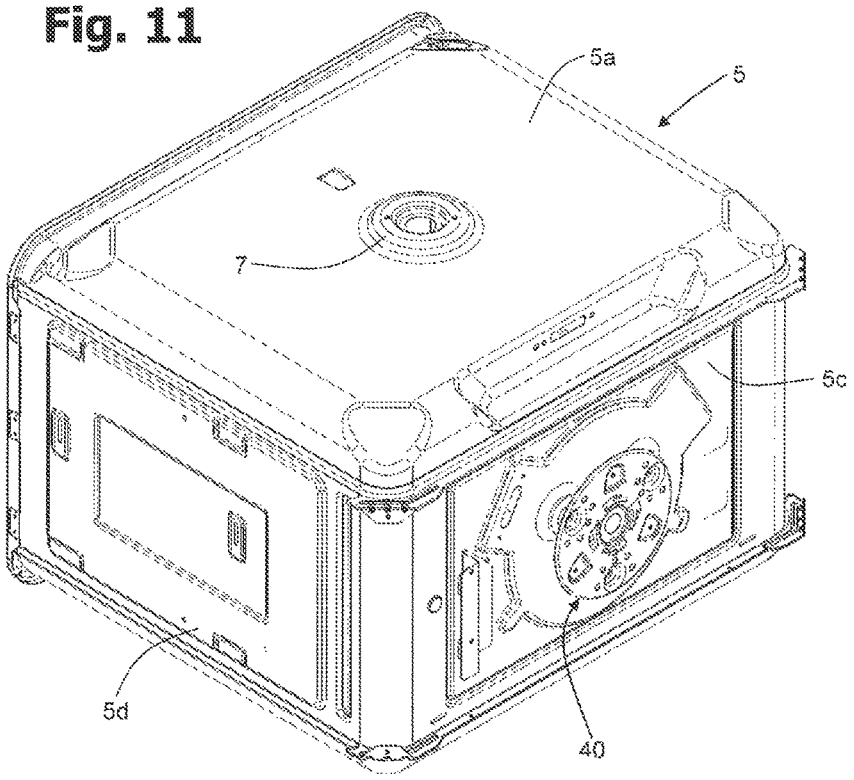

METHOD FOR MANUFACTURING A HOUSEHOLD COOKING APPLIANCE, AND CORRESPONDING HOUSEHOLD COOKING APPLIANCE

FIELD OF THE INVENTION

The present invention relates to household cooking appliances and to the corresponding manufacturing methods. The invention has been developed with particular reference to cooking appliances comprising a cooking chamber, defined by a muffle, and a channelling for conveying air, which extends over an upper wall of the muffle.

PRIOR ART

Appliances of the type referred to above are known and are typically constituted by cooking ovens or kitchen ranges comprising a cooking oven and include a metal load-bearing structure associated to which are the muffle, which delimits the cooking chamber, and a corresponding front door.

In some ovens, the muffle has, in an area corresponding to its upper wall, a flue for expulsion of fumes from the cooking chamber, and extending over this upper wall is a channelling into which the flue gives out. The channelling, which is generally formed in one or more parts of sheet metal, is shaped so as to have a corresponding outlet at the front of the appliance. Some of these ovens also comprise a second fan, associated to a rear end of the channelling so as to force an air/fume mixture along the channelling itself and expel it from its outlet, on the front of the appliance. The fan used is typically a tangential fan with horizontal axis, which, in some solutions, has a volute defining an air intake, for taking in air from inside the structure of the appliance, generally from an area behind the rear wall of the muffle. The channelling may also be divided into a delivery duct, for the aforesaid air/fume mixture, and a duct for intake of air from outside, which extends underneath the delivery duct and has an inlet at the front of the appliance, substantially at the upper portion of the door, but underneath the outlet of the delivery duct.

In some cases a channelling of the type indicated above is used—not necessarily in combination with a flue—for inducing flows of cooling air into one or more gaps of its front door, in particular when the appliance has functions of pyrolytic cleaning of the cooking chamber.

It is then known that, in ovens of a ventilated type, generally provided inside the muffle is a metal partition wall, mounted in a position facing the rear wall of the muffle itself. This partition wall divides the internal cavity of the muffle into a front cooking chamber, which extends between the door and the partition wall, and a rear air-distribution chamber, which extends between the partition wall and the rear wall of the muffle. Operatively set in this air-distribution chamber are at least one rear heating resistance, which usually has a circular shape, and the impeller of a centrifugal fan, which is usually positioned within a region circumscribed by the resistance. The motor of the fan, with a corresponding support, is mounted on the outside of the rear wall of the muffle.

In general, the support of the motor is mounted on a quadrangular bracket, which is fixed to the rear edges of two side walls of the load-bearing structure of the appliance. An intermediate region of the quadrangular bracket is set up against and fixed to the rear wall of the muffle. In this intermediate region, the quadrangular bracket has a through hole aligned to a through hole of the rear wall of the muffle, for the shaft of the motor of the fan, fitted on which is the corresponding impeller.

This type of embodiment is relatively laborious as a result of the need to fix the quadrangular bracket both to the load-bearing structure of the appliance and to the rear wall of the muffle and entails a significant use of metal material to produce the bracket.

SUMMARY OF THE INVENTION

In view of what has been set forth above, the object of the present invention is to provide a cooking appliance, including a ventilated cooking cavity and a channelling for conveying air, that is extremely simple and inexpensive to manufacture.

The above object is achieved, according to the present invention, by a method for manufacturing a cooking appliance and by a cooking appliance that present the characteristics indicated in the annexed claims.

BRIEF DESCRIPTION OF THE DRAWINGS

Further objects, characteristics, and advantages of the present invention will emerge clearly from the ensuing detailed description, with reference to the annexed schematic drawings, wherein:

FIGS. 9 and 10 are perspective views from different angles of the sheared portion represented in FIG. 8; and FIG. 11 is a schematic perspective view of the muffle of FIG. 2 or of FIG. 5, associated to the rear wall of which is the sheared part represented in FIGS. 9-10.

DESCRIPTION OF PREFERRED EMBODIMENTS OF THE INVENTION

Reference to "an embodiment" or "one embodiment" in the framework of the present description is meant to indicate that a particular configuration, structure, or characteristic described in relation to the embodiment is comprised in at least one embodiment. Hence, phrases such as "in an embodiment" or "in one embodiment" and the like that may be present in various points of this description do not necessarily refer to one and the same embodiment of the oven forming the subject of the invention. In addition, particular conformations, structures, or characteristics may be combined in any adequate way in one or more embodiments, even different from the ones represented. The references used herein are only provided for convenience and hence do not define the sphere of protection or the scope of the embodiments. Moreover, the cooking appliance will be described in what follows limitedly to the elements necessary for an understanding of the invention, it being taken for granted that it includes all the other components normally known and necessary for its operation.

Figure 1:
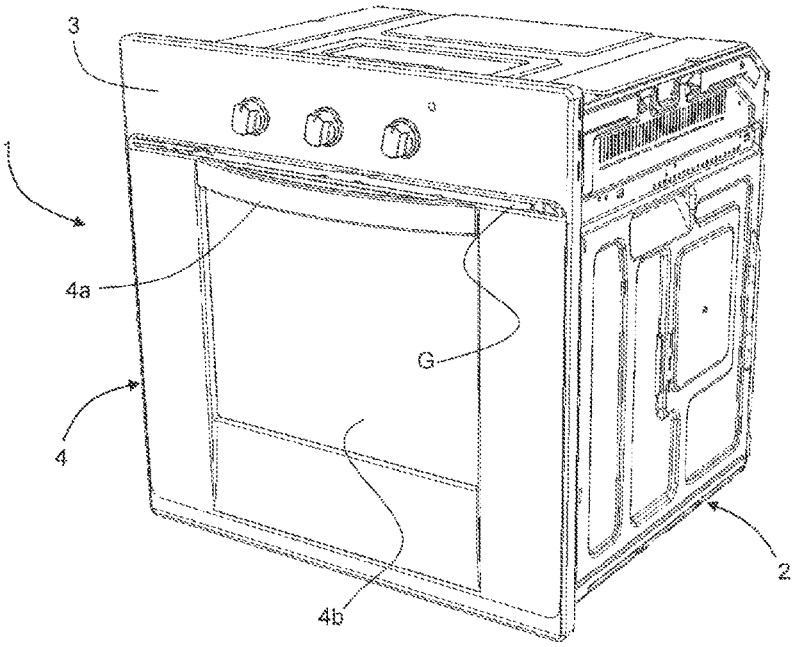
FIG. 1 is a schematic perspective view of a cooking appliance according to the invention.

With initial reference to FIG. 1, designated as a whole by 1 is a household cooking appliance according to the invention, represented herein by a built-in oven. The invention may be applied also to free-standing ovens and kitchen ranges integrating an oven 1. The oven 1 has a load-bearing structure or body, designated by 2, associated in a stationary way to the front of which is a control panel 3. Also associated to the front part of the body 2 is a front door 4, which in particular is hinged in a lower region thereof and is provided with a handle 4*a*. The structure of the door 4, which is preferably at least in part made of metal, may comprise a plurality of door panels, just one of which is designated by 4*b*, which define between them a series of cooling chambers. The lower edge of the control panel 3 and the upper end of the door 4 are separated from one another by a space or gap, designated by G. The presence of this gap G prevents the control panel 3 from constituting a hindrance to opening of the door 4 itself and—as will emerge hereinafter—enables passage of at least one flow forced by a fan.

Figure 2:
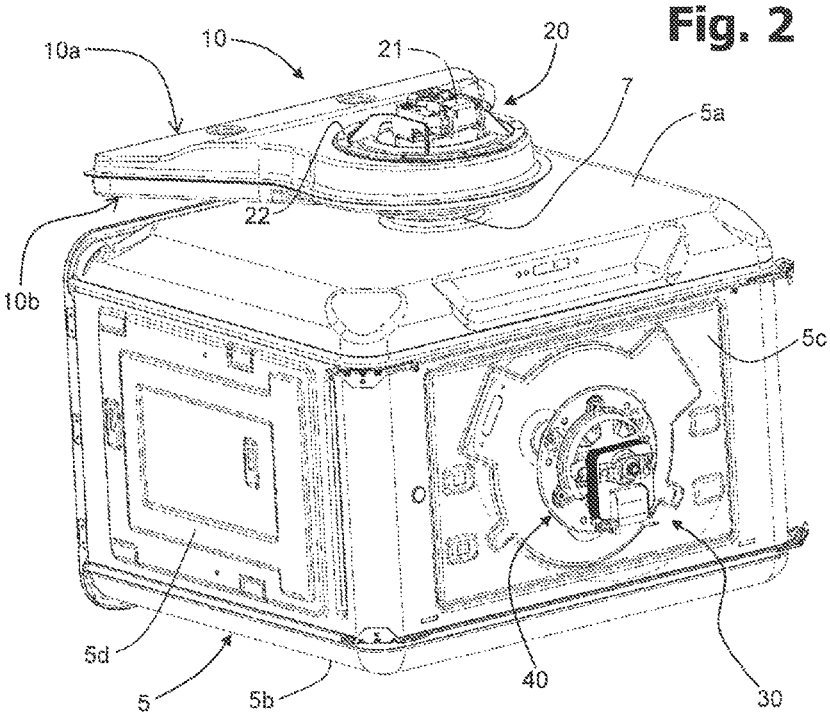
FIG. 2 is a schematic perspective view of a muffle of a cooking appliance according to the present invention, provided with a rear fan and a channelling for the conveying air and/or fumes.

Housed inside the body 2 is a muffle, designated as a whole by 5 in FIG. 2, which may be made of a single piece or of a number of parts fixed together, made of sheet metal. The muffle 5 has a rigid metal body, for example obtained from sheet metal, which has an upper wall, a lower wall, a rear wall, and two side walls (just one of which is visible), designated by 5*a*, 5*b*, 5*c* and 5*d*, respectively. The muffle 5 is preferentially thermally insulated via an insulating cladding, of a conception in itself known and not represented. The body of the muffle 5 defines a cooking cavity (not visible), which can be opened and closed at the front by means of the door 4 of FIG. 1. For this purpose, associated to the muffle 5 are means (not visible either) for heating the cooking cavity, which comprise, for example, a circular rear resistance, as mentioned in the introductory part of the present description.

Designated as a whole by 10 is a channelling for conveying air, with a fan 20 associated thereto, provided with a corresponding electric motor 21 and a support 22. The channelling 10 may form part of a system for extracting fumes from the muffle 5. In addition or as an alternative, the channelling 10 may form part of a system for cooling the door 4, when the latter has one or more cooling chambers. The channelling 10 preferentially includes at least one delivery duct, the outlet of which is located at the front of the appliance 1. On the other hand, the channelling 10 may define both an intake duct and a delivery duct set on top of one another, with the inlet of the latter at the front of the appliance 1. The channelling 10 preferentially has a generally tapered shape, starting from its front part towards its rear end region, where the fan 20 is mounted.

The channelling 10 is associated to the upper wall 5*a* of the muffle 5 and preferably extends over the upper wall 5*a* so that its front part, here having a width roughly corresponding to the width of the muffle 5, is located in the proximity of the gap G and of the upper portion of the door 4. The fan 20 is mounted at an opening (not represented herein) of the upper wall of the channelling 10, present in the rear region of the latter. In the non-limiting example illustrated, the channelling 10 is made up of two components coupled together, designated by 10*a* and 10*b*, obtained by pressing of sheet metal and basically configured as half-shells.

To the outer side of the rear wall 5*c* of the muffle a fan 30 is associated by means of a corresponding supporting bracket 40 provided according to the present invention, which is preferentially disk-shaped. As will emerge more clearly hereinafter, the bracket 40 is made of the same sheet metal and has the same thickness as the component 10*a* of the channelling 10.

Figure 3:
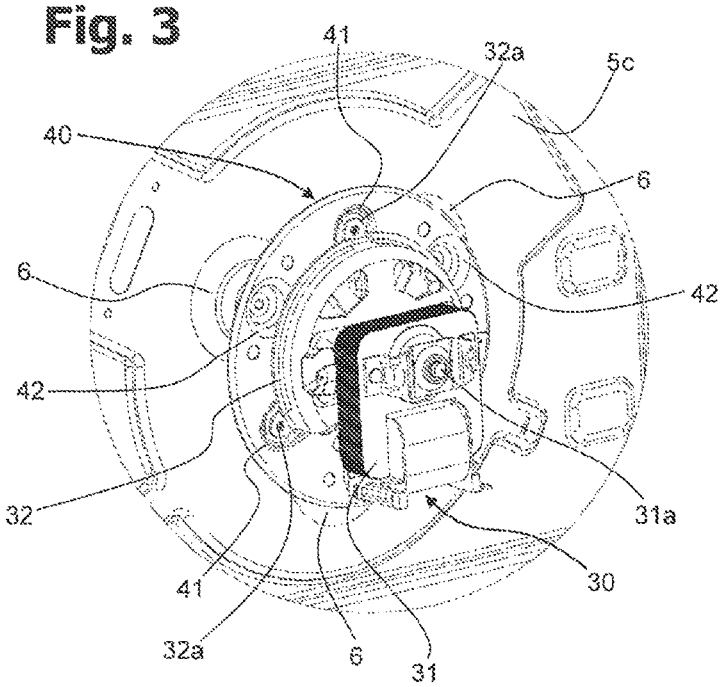
FIG. 3 is a detail at an enlarged scale of the muffle of FIG. 2.

Clearly visible in FIG. 3 is the fan 30, comprising a corresponding electric motor 31 and a support 32, which defines respective fixing appendages, some of which are designated by 32*a* and which are provided with a through hole. The appendages 32*a* are positioned within respective positioning seats 41, preferably seats 41 recessed towards the rear wall 5*c* of the muffle 5, which are defined in the disk-shaped bracket 40. The bracket 40 moreover defines a series of positioning protrusions or projections, designated by 42. These projections 42, which are also preferably recessed towards the rear wall 5*c* of the muffle 5, are brought up against and fixed to respective protrusions or projections 6 projecting from the above rear wall 5*c*.

The shaft 31*a* of the motor passes through respective holes of the bracket 40 and of the rear wall 5*c* of the muffle 5 in order to project into the cavity of the latter. Fitted to the end of the shaft 31*a* (not visible) is a centrifugal impeller (not visible), which is for example located in the area circumscribed by the rear circular resistance referred to previously. As per the known technique, on the inside of the muffle 5 there may be provided a partition wall, which divides its cavity into a front cooking chamber and a rear air-distribution chamber, where the above resistance and impeller are located.

Figure 4:
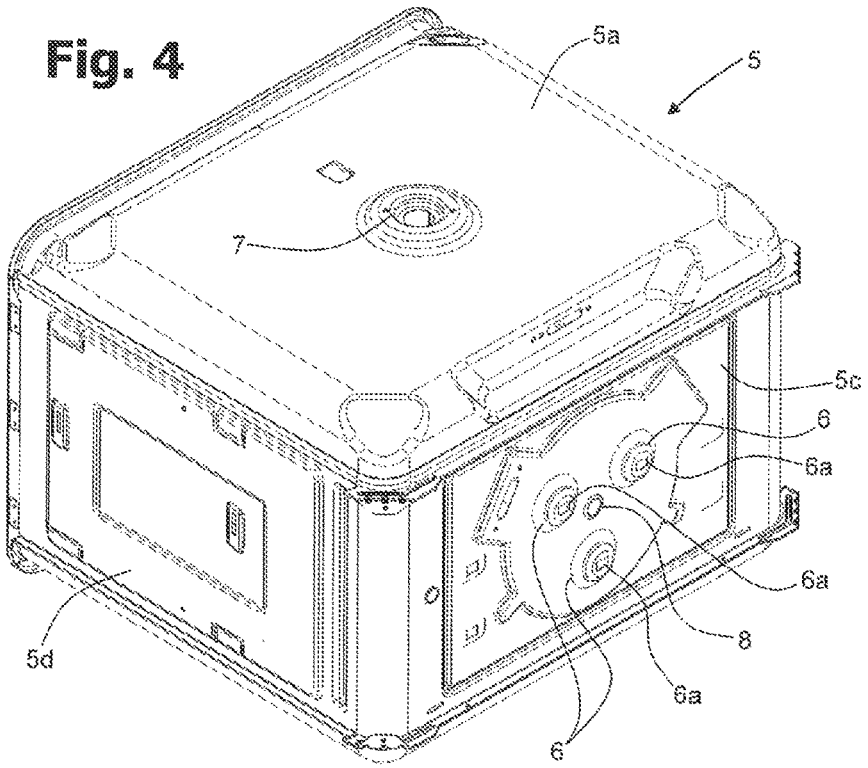
FIGS. 4 and 5 are perspective views of the muffle of FIG. 2, in two different steps of a corresponding manufacturing method.

Visible in FIG. 4 is just the body of the muffle 5, defined in the upper wall 5*a* of which is a fume outlet 7. The fume outlet 7 comprises a through hole or through opening of the upper wall 5*a*, which is preferentially defined in a central area of the wall itself. In the embodiment exemplified in FIG. 2, this fume outlet 7 is connected to a respective inlet defined in the lower component 10*b* of the channelling 10. Once again visible in FIG. 4 is the rear wall 5*c* of the muffle 5, defined in the central area of which are the projections 6, for example three projections arranged substantially at approximately 120° from one another. In a central position with respect to the projections 6, the rear wall 5*c* has a through hole 8 for the shaft 31*a* of the motor 31 of the fan 30 (FIG. 3).

Figure 5:
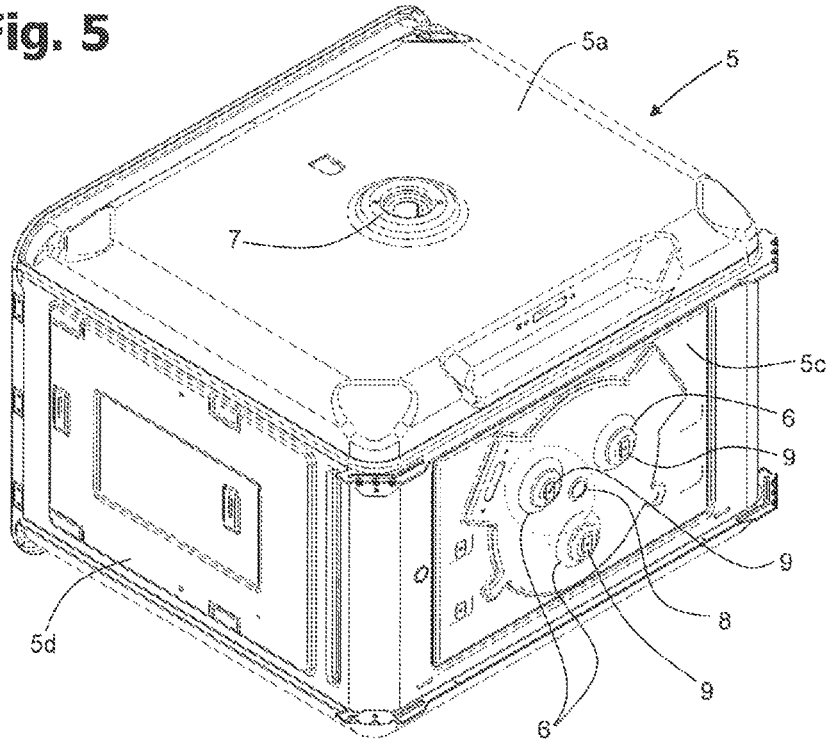
Figure 6:
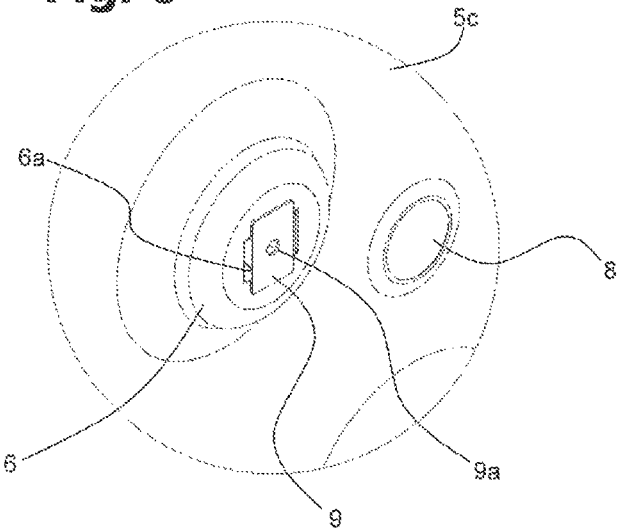
FIG. 6 is a detail at a larger scale of the muffle of FIG. 5.

The projections 6, which preferentially have a generally planar top, are provided with corresponding through openings 6*a*. In a preferred embodiment, these through openings 6*a* are substantially quadrangular in order to enable installation of corresponding clips 9, as may be seen in FIG. 5 and in the corresponding detail of FIG. 6. These clips 9, provided with corresponding threaded through holes 9*a* or having an associated nut, are used for fixing the bracket 40 to the rear wall 5*c* of the muffle 5, via threaded means, for example screws. In a different embodiment, on the other hand, the through openings 6*a* are configured as simple through holes for receiving respective threaded fixing means, for example self-tapping screws.

Figure 7:
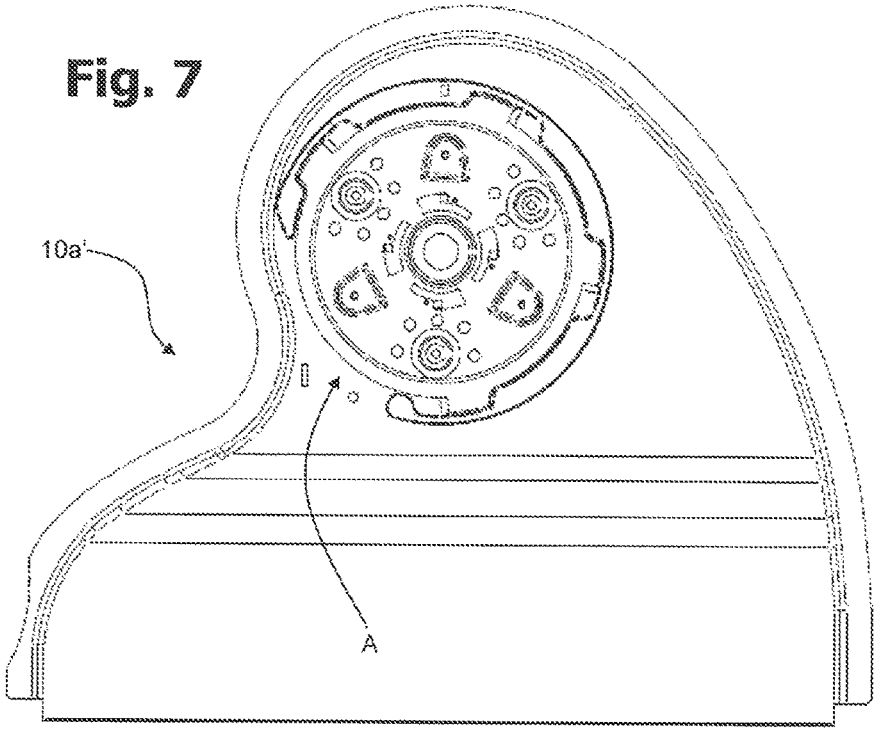
FIG. 7 is a schematic top plan view of a semi-finished form of a component of the channelling of FIG. 2.

Visible in top plan view in FIG. 7 is a semi-finished product, designated by 10*a*', from which it is possible to obtain the upper component 10*a* of the channelling 10. The component 10*a*, and hence the semi-finished product 10*a*', is obtained from sheet metal of a given thickness via pressing and shearing operations.

Figure 8:
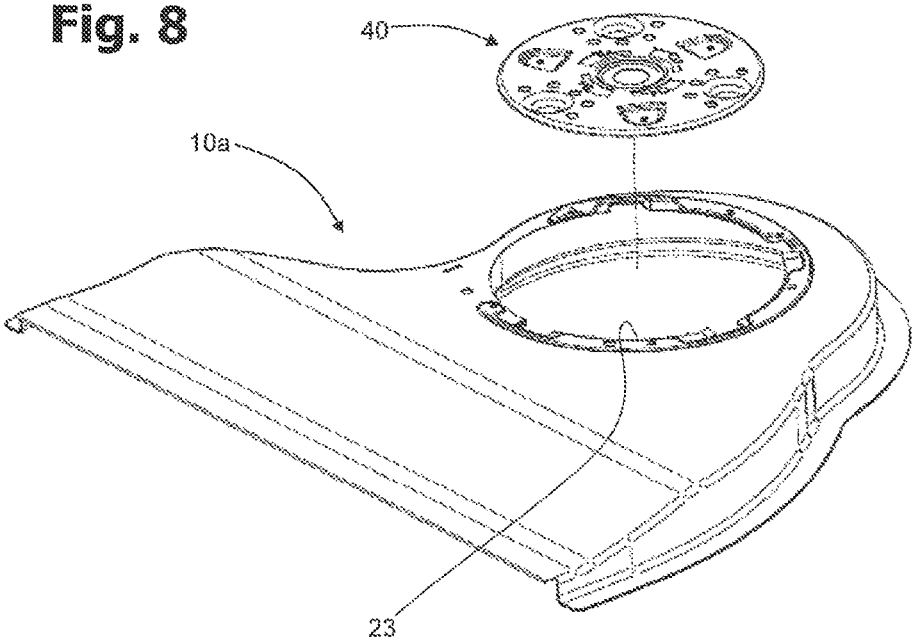
FIG. 8 is a schematic perspective view of the component obtained from the semi-finished product of FIG. 7, with a corresponding portion sheared.

In a step of pressing of the semi-finished product 10*a*', for example with a suitable punch, an impression is defined that reproduces the shape of the supporting bracket 40, including the seats 41, the projections 42, and a through hole 8 for passage of the shaft of the motor 31, this impression being designated as a whole by A in FIG. 7. The impression A is made at the area where the fan 20 of the channelling 10 is to be installed, in the rear region of the semi-finished product 10*a*' itself, and hence of the component 10*a*. Next, the part including the impression A is sheared from the semi-finished product 10*a*', thus obtaining simultaneously the supporting bracket 40 and an opening for installation of the fan 20. FIG. 8 is a schematic illustration of the result of the aforesaid shearing operation, which enables the component 10*a* of the channelling 10 to be obtained, with the respective opening 23—here circular—for installation of the fan 20, as well as the supporting bracket 40 for the fan 30. Evidently, in this way, the supporting bracket 40 and the component 10*a* will be made out of one and the same sheet material of the same thickness.

The supporting bracket 40 is visible in different views in FIGS. 9 and 10, with the respective positioning seats 41 and positioning protrusions or projections 42, provided with the corresponding end holes or openings. In a central area with respect to seats and projections (which here are both three in number, arranged at approximately 120° from one another) the aforesaid central through hole is present, designated by 43, for the shaft 31*a* of the fan 30.

As may be seen in FIGS. 9 and 10, in a possible embodiment the bracket 40 comprises further positioning seats 44, for example four seats, for use in the case where the support of the motor 31 is provided with appendages or bayonet fittings. In the example represented, the seats 44 are through seats obtained by shearing around the central hole 43. The seats 44 may be provided in addition or as an alternative to the seats 41. In the case where the seats 41 are not envisaged and the support for the motor 31 is provided with appendages or bayonet fittings, the supporting bracket 40 may include through holes (some of which are visible but are not designated by references) in the area of the seats 44, to secure the support for the motor 31 to the supporting bracket 40 also with screws.

FIG. 11 represents a subsequent step of production of the cooking appliance, where the supporting bracket 40 is mounted on the rear wall 5*c* of the muffle 5. For this purpose, the projections 42 of the supporting bracket 40 are brought up against the projections 6 projecting from the rear wall 5*c* so that they can be fixed there via screws that engage the holes 9*a* of the clips 9 of FIG. 6. Following upon this fixing operation, the central hole 8 (FIG. 5) of the rear wall 5*c* of the muffle 5 and the central hole 43 of the supporting bracket 40 are aligned to one another. As has been mentioned, the projections 6 could also be provided with simple through holes 6*a*, where the protrusions 42 can be fixed via self-tapping screws.

After installation of the supporting bracket 40 as represented in FIG. 11, the shaft 31*a* of the motor 31 is inserted through the aligned holes 8 and 43, making sure that the fixing appendages 32*a* of the corresponding support 32 (FIG. 3) are aligned with the respective seats 41 of the supporting bracket 40. At this point, the support 32 of the motor 31 can be fixed to the supporting bracket 40 via threaded means that engage the holes of the seats 41 and of the fixing appendages 32*a*, for example bolts or self-tapping screws. Obviously, fixing of the support 32 to the supporting bracket 40 may be carried out also before fixing of the latter to the rear wall 5*c* of the muffle 5. In the case where the support of the motor 31 envisages a bayonet coupling with the supporting bracket 40, the seats 44 described just above can be exploited.

Once this fixing operation is completed, the impeller of the fan 30 can be associated to the corresponding shaft 31*a*, on the inner side of the muffle 5.

The perimetral dimensions or the diameter of the supporting bracket 40 do not necessarily correspond exactly to the perimetral dimensions or to the diameter of the opening 23. The dimensions may differ on account of machining tolerances and residue, or else may differ in the case where the supporting bracket 40 is to be provided with a peripheral rim bent back. In general terms, the perimetral dimensions of the supporting bracket 40 are comprised between 80% and 100% of the perimetral dimensions of the opening 23, preferably comprised between 85% and 95%, very preferably comprised between 88% and 92%.

In the solution according to the invention, the fan 20 is a radial fan having a centrifugal impeller. The corresponding support 22, which is preferably made of metal and here has a generally annular configuration, is coupled and fixed to the component 10*a* of the channelling 10 at the opening 23 of FIG. 8. Preferentially, the diameter of the opening 23 is greater than the diameter of the impeller of the fan 20 in order to enable easy insertion of the latter within the channelling 10, in the production stage. Preferentially (see FIG. 2), the support 22 has an annular peripheral part, which rests and is fixed substantially along the rim of the opening 23, and a series of substantially radial uprights for supporting the motor 21 of the fan 20 on the outside of the channelling 10. The annular part of the support 22 is fixed around the opening 23 preferably via threaded means or rivets, possibly with the aid of brackets. The motor 21 has a single shaft that identifies the axis of rotation of the centrifugal impeller and that projects down from the body of the motor 21 for supporting the impeller itself in a rotatable way within the channelling 10. The channelling 10 then has at least one air intake. In the example, the support 22 has a structure that is partially annular and partially spoked so as to define a series of passages (not shown), which, together with the opening 23 of the component 10*a*, provide an upper air intake. Use of the radial fan 20, among other things, affords the advantage that the channelling 10 itself can provide the volute for the centrifugal impeller fan 20: for this purpose, as highlighted for example in FIG. 2, the rear end region of the channelling 10 has a generally arched peripheral profile.

The channelling 10, when it is equipped with the corresponding fan 20, can be associated to the upper wall 5*a* of the muffle 5, for example via brackets associated to the body 2 of FIG. 1, in such a way that a lower inlet thereof, defined in the component 10*b* (FIG. 2), will be located in a position corresponding to the fume outlet 7.

From the foregoing description, the characteristics of the present invention emerge clearly, as likewise do its advantages. The solution according to the invention enables simplification of fixing of the rear fan 30, without any need for anchorages also to the load-bearing structure of the appliance 1. The supporting bracket 40 can be of contained dimensions, with consequent significant saving of material. Advantageously, moreover, the supporting bracket 40 is obtained from a part that must in any case be sheared from a different component, i.e., a component of the channelling for conveying the air, with consequent further saving in terms of materials used and machining operations.

It is clear that numerous variations may be made by the person skilled in the art to the cooking appliance 1 described by way of example, without thereby departing from the scope of the invention as defined by the ensuing claims.

The invention claimed is:

1. A method for manufacturing a household cooking appliance, in particular an oven, having a muffle defining a cooking chamber, comprising steps of:

a) providing a muffle;

b) forming a channel for conveying air;

c) disposing a first fan in communication with a rear wall of the muffle for ventilation of the cooking chamber;

d) disposing a second fan in communication with the channel for forcing air into the channel;

e) coupling the channel with an upper wall of the muffle, wherein the step of forming the channel includes shearing a support bracket from a semi-finished product of a metal component of the channel to define a mounting opening for the second fan; and wherein the step of disposing the first fan includes using the support bracket sheared from the semi-finished product to fix the first fan to the rear wall of the muffle.

2. The method according to claim 1, wherein the step of forming the channel further includes pressing the semi-finished product of the metal component of the channel before shearing to define within the support bracket at least one of:

a hole for passage of a shaft of the first fan;

positioning protrusions for fixing the support bracket to the rear wall of the muffle; and positioning seats adapted to engage a support of the first fan.

3. The method according to claim 2, wherein pressing the semi-finished product to form at least one of the positioning protrusions and the positioning seats defines corresponding through holes.

4. The method according to claim 1, wherein the step of providing the muffle includes pressing the rear wall of the muffle to define therein respective positioning projections, for fixing of the sheared support bracket to the rear wall of the muffle.

5. The method according to claim 4, wherein pressing the rear wall of the muffle to define the positioning projections further defines corresponding through openings.

6. The method according to claim 5, further comprising the step of:

mounting fixing clips at the through openings of the positioning projections of the rear wall of the muffle.

7. The method according to claim 5, further comprising steps of:

leaning the positioning projections of the support bracket against the positioning projections of the rear wall of the muffle; and securing together the positioning protrusions of the support bracket and the positioning projections of the rear wall using threaded fixing means.

8. The method according to claim 2, further comprising steps of:

coupling the support of the first fan to the positioning seats of the support bracket using respective coupling parts; and securing the coupling parts in the positioning seats using threaded fixing means.

9. The method according to claim 1, wherein the support bracket is substantially disk-shaped.

10. A household cooking appliance, in particular an oven, formed using the method of claim 1 and comprising:

a muffle defining a cooking chamber and a channel for conveying air extending over an upper wall of the muffle, wherein a first fan is coupled to a rear wall of the muffle for ventilation of the cooking chamber, and wherein a second fan is coupled to the channel for forcing air into the channel.

* * * * *